US011020768B2

(12) United States Patent
Grimm et al.

(10) Patent No.: US 11,020,768 B2
(45) Date of Patent: Jun. 1, 2021

(54) VIBRATORY CLASSIFIERS

(71) Applicant: Superior Industries, Inc., Morris, MN (US)

(72) Inventors: Lafe Grimm, Hancock, MN (US); Ryan Larson, Atwater, MN (US)

(73) Assignee: Superior Industries, Inc., Morris, MN (US)

( * ) Notice: Subject to any disclaimer, the term of this patent is extended or adjusted under 35 U.S.C. 154(b) by 201 days.

(21) Appl. No.: 16/266,590

(22) Filed: Feb. 4, 2019

(65) Prior Publication Data

US 2020/0246832 A1 Aug. 6, 2020

(51) Int. Cl.

| | |
|---|---|
| ***B07B 1/16*** | (2006.01) |
| ***B07B 1/46*** | (2006.01) |
| ***B07B 1/36*** | (2006.01) |

(52) U.S. Cl.

CPC ..... *B07B 1/16* (2013.01); *B07B 1/36* (2013.01); *B07B 1/4636* (2013.01)

(58) Field of Classification Search

CPC ..... B07B 1/16; B07B 1/4636; B07B 1/36; B07B 1/42; B07B 1/12

See application file for complete search history.

(56) References Cited

U.S. PATENT DOCUMENTS

| | | | | |
|---|---|---|---|---|
| 1,961,534 | A * | 6/1934 | Symons | B07B 1/16 209/396 |
| 2,251,678 | A | 5/1941 | Holt | |
| 2,974,795 | A * | 3/1961 | Behnke | B07B 1/16 209/247 |
| 3,105,815 | A * | 10/1963 | Behnke | B07B 1/286 209/247 |
| 3,971,716 | A * | 7/1976 | Foreman | B07B 1/16 209/396 |
| 5,335,784 | A | 8/1994 | Tyler | |
| 5,392,930 | A * | 2/1995 | Jones | B07B 1/12 209/674 |
| 6,098,811 | A | 8/2000 | Schaefer | |
| 7,673,755 | B2 * | 3/2010 | Gemmill | B07B 1/42 209/405 |
| 9,333,537 | B2 * | 5/2016 | Archer | B07B 4/08 |
| 9,649,665 | B2 * | 5/2017 | Luukkonen | B07B 1/42 |
| 9,862,003 | B2 * | 1/2018 | Sauser | B07B 1/42 |
| 2018/0056330 | A1 * | 3/2018 | Stemper | B07B 1/42 |

FOREIGN PATENT DOCUMENTS

| | | |
|---|---|---|
| CN | 205217340 | 5/2016 |
| CN | 205217340 U * | 5/2016 |
| WO | 2018031517 | 5/2018 |

OTHER PUBLICATIONS

PCT International Search Report and Written Opinion dated Oct. 24, 2017.

* cited by examiner

*Primary Examiner* — Patrick H Mackey

(74) *Attorney, Agent, or Firm* — Dicke, Billig & Czaja, PLLC

(57) ABSTRACT

Vibrating classifier embodiments such as vibrating grizzly feeders are provided. Some embodiments include a reconfigurable grizzly bar classifier.

23 Claims, 14 Drawing Sheets

VIBRATORY CLASSIFIERS

CROSS REFERENCE TO RELATED APPLICATIONS

This application is a U.S. National Stage application of PCT/US2017/045844 filed Aug. 8, 2017 and claims the benefit of U.S. Provisional Patent Application Ser. No. 62/372,563, filed Aug. 9, 2016, and U.S. Provisional Patent Application Ser. No. 62/410,660, filed Oct. 20, 2016, all of which are incorporated by reference herein.

BACKGROUND

Vibratory classifiers (such as screens and feeders) use vibration to move material such as aggregate to separate the material into different constituent sized material elements. Grizzly bar classifiers generally are a spaced arrangement of structural metal beams (commonly referred to as grizzly bars) supported on a frame that are capable of supporting material that is larger than the spacing of the bars and allow material smaller than the spacing of the bars to pass between the bars.

DETAILED DESCRIPTION

Referring to FIGS. 1 through 12, one embodiment of a vibratory classifier is illustrated in two configurations. Various embodiments may be referred to as feeders or grizzly feeders. In some embodiments, although not required, a spring assembly of the vibratory feeder may include a lift support. In some embodiments, a classifying deck (e.g., grizzly bar classifier which may be referred to as a cassette) and corresponding supports are adjustable between a plurality of (e.g., at least two) configurations.

Figure 1:
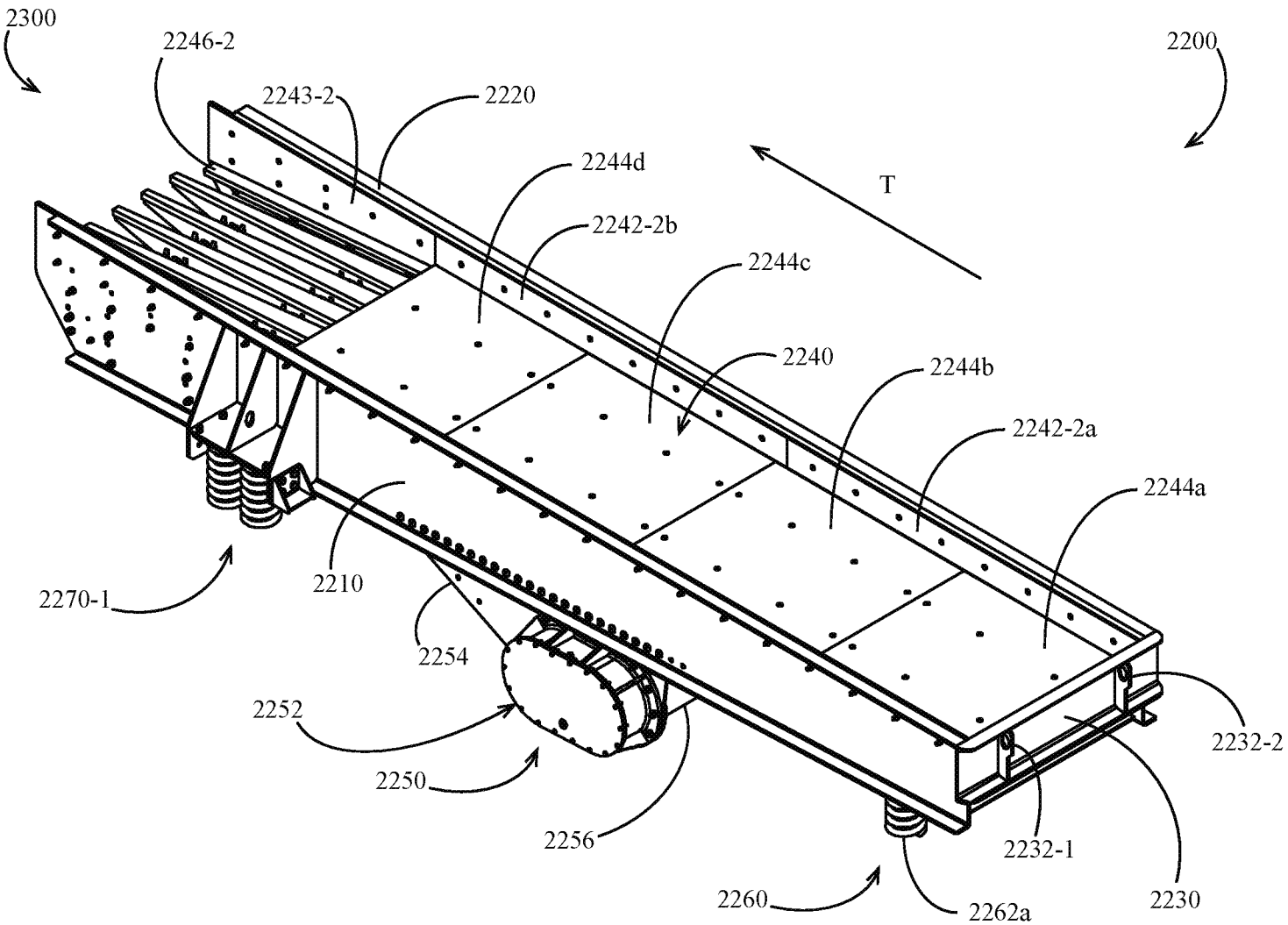
FIG. 1 is a perspective view of an embodiment of a vibratory classifier in a first configuration.

Turning to FIG. 1, a vibratory feeder 2200 is illustrated in a first configuration. A deck having an upper surface 2240 is optionally disposed to receive aggregate and/or other material to be classified. The upper surface 2240 is optionally disposed generally horizontally or in some embodiments at a downwardly-sloping angle between sidewalls 2210, 2220 of the feeder. A general direction of travel T of aggregate material on surface 2240 is illustrated in FIG. 1, although it should be appreciated that the path of travel of material on the surface may include complex movement as the material bounces against the surface.

Figure 8:
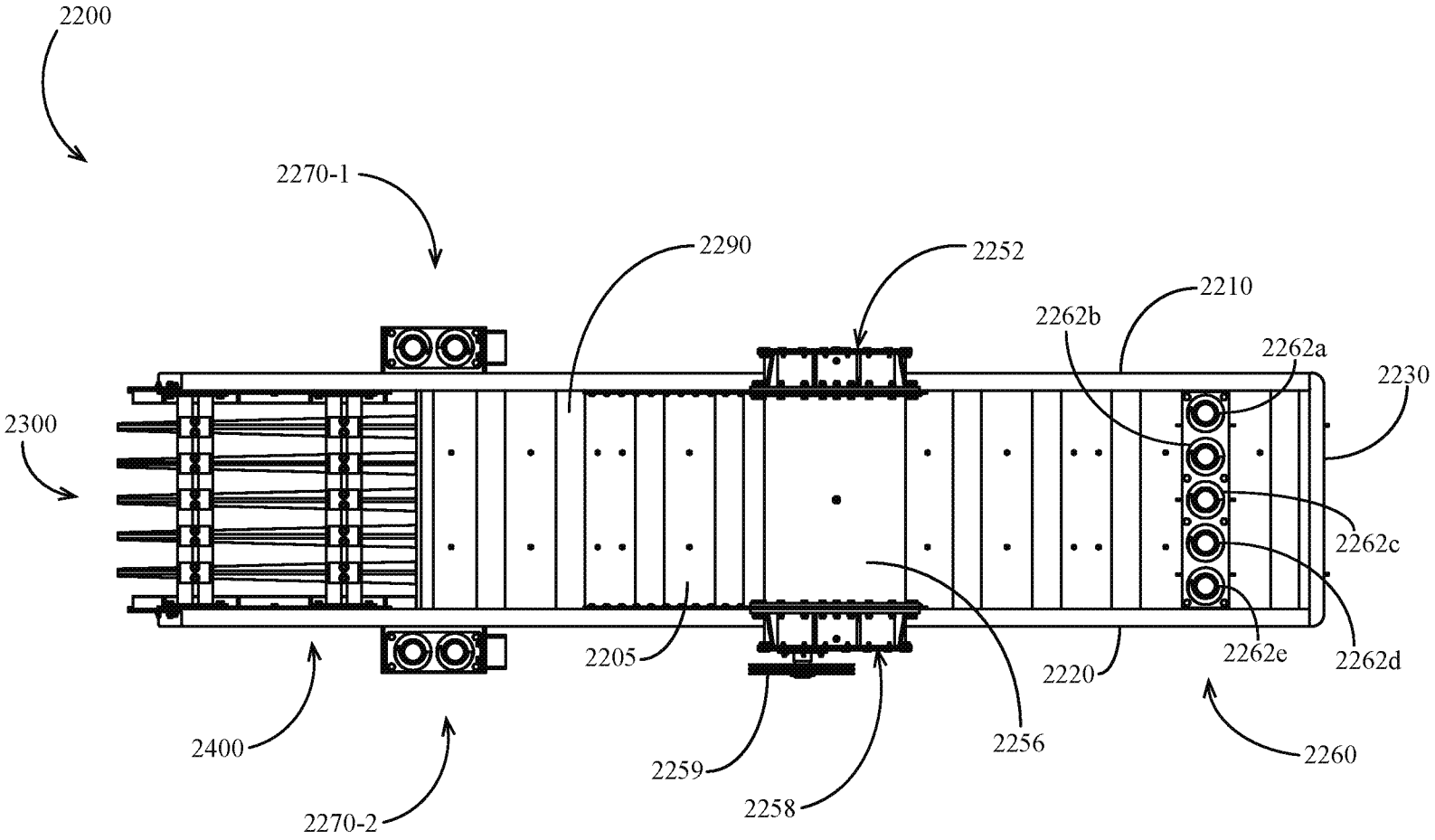
FIG. 8 is a bottom view of the vibratory classifier of FIG. 1.

The feeder 2200 is optionally driven for vibration by a vibration assembly 2250 (e.g., including one or more eccentric shafts which may be disposed at a lower end of the feeder, including one or more eccentric weights, etc.). Referring to FIGS. 1 and 8, a first drive housing 2258 may contain one or more driven elements (e.g., gears) for driving one or more shafts (e.g., eccentric shafts, non-eccentric shafts, etc.) which are optionally housed in a shaft housing 2256. The drive elements and shafts are optionally driven by a drive wheel 2259 (e.g., sheave) which is optionally directly or indirectly driven by a motor (not shown) such as an electric motor. The shafts optionally extend transversely across the width of the feeder 2200 and are optionally driven and/or supported by drive elements (e.g., gears, bearings, wheels, etc.) disposed in a second drive housing 2252. One or more eccentric weights are optionally supported on the shaft (e.g., near left and right ends of the shaft). The drive housing 2252 is optionally supported on the sidewall 2210, e.g., by being mounted to a plate 2254 supported on the sidewall 2210. It should be appreciated that other mechanisms may be employed to vibrate the feeder 2200 in various embodiments.

Figure 2:
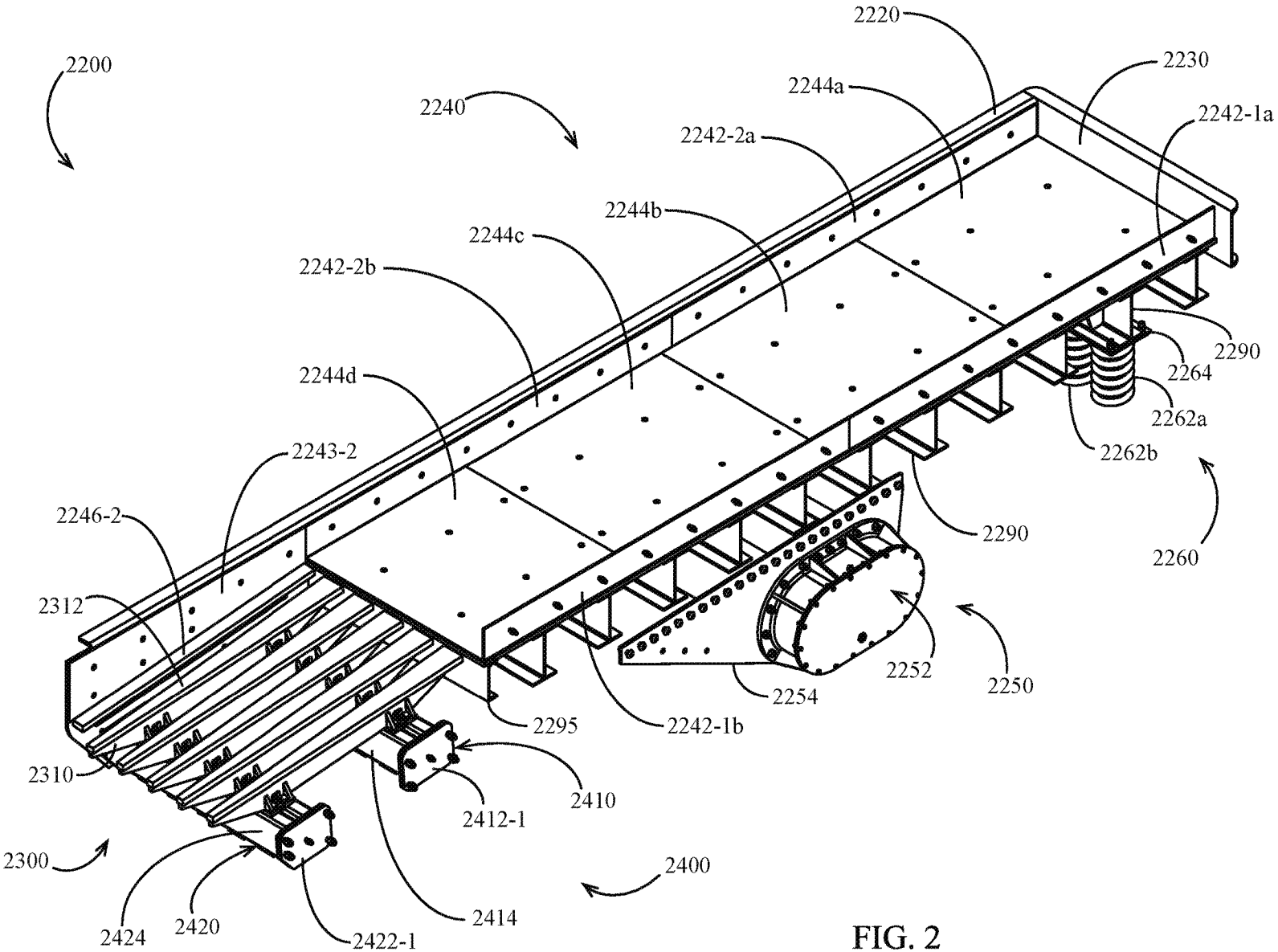
FIG. 2 is a perspective view of the vibratory classifier of FIG. 1 in the first configuration, with certain components including a sidewall not shown for clarity.
Figure 3:
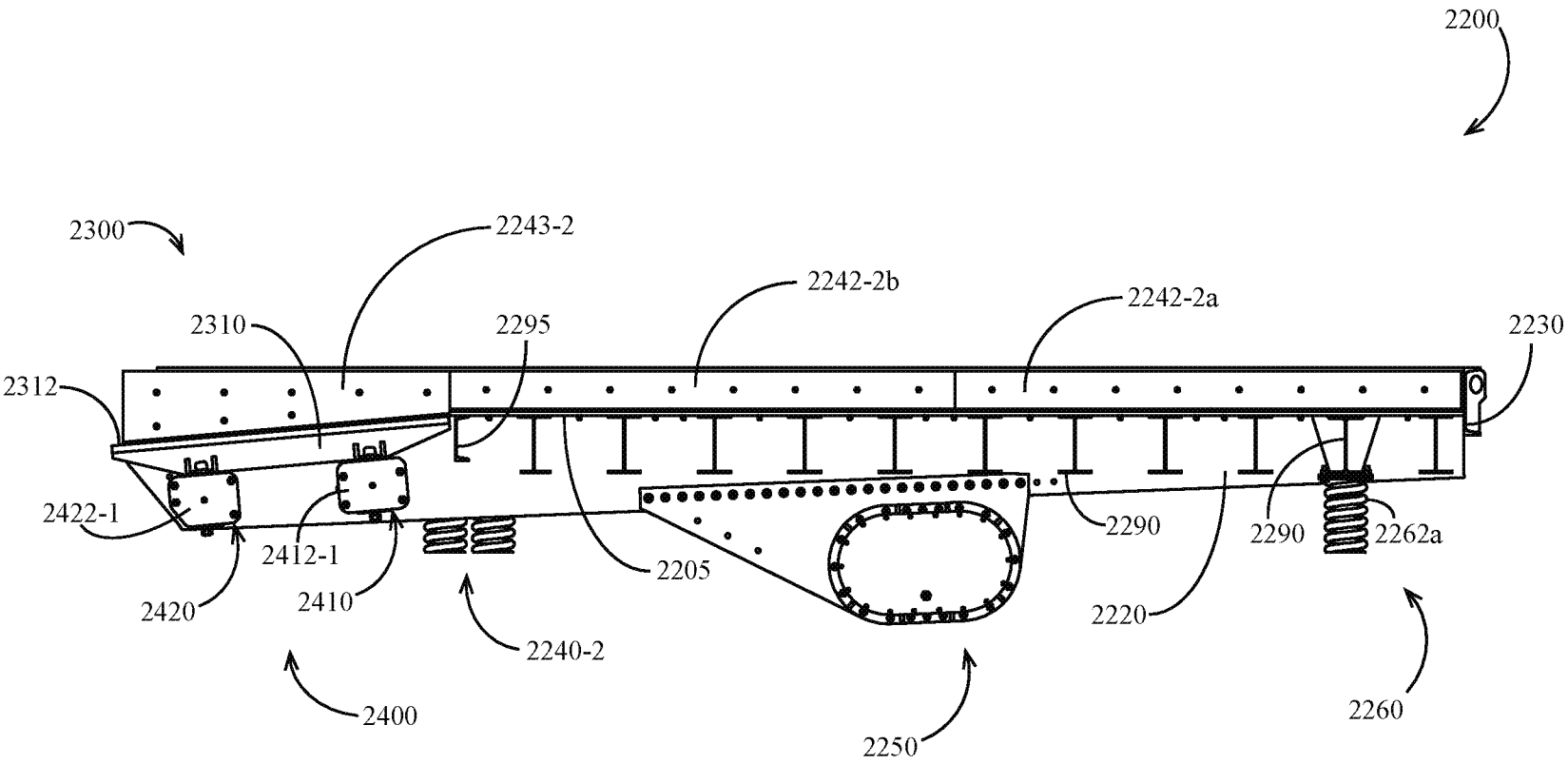
FIG. 3 is a side elevation view of the vibratory classifier of FIG. 1 in the first configuration, with certain components including a sidewall not shown for clarity.

Referring to FIGS. 2, 3 and 8, the feeder 2200 is optionally resiliently supported on a plurality of spring assemblies which may vary in configuration and location in various embodiments. In some embodiments, the feeder 2200 is supported on left and right forward spring assemblies 2240-1, 2240-2, respectively. In some embodiments, the feeder 2200 is supported on rearward spring support assembly 2260 which may include a plurality of springs 2262 (e.g., 2262*a*, 2262*b*, 2262*c*, 2262*d*, 2262*e*) which are optionally disposed in transverse relation at least partially along the width of the feeder.

The upper surface 2240 optionally comprises one or more removable plates 2244 (e.g., 2244*a*, 2244*b*, 2244*c*, 2244*d*). The plates 2244 may comprise a wear resistant material such as abrasion-resistant steel. The plates 2244 may be removably mounted (e.g., by fasteners such as bolts) to one or more support plates 2205. The support plate 2205 is optionally supported on (e.g., welded to) a plurality of supports 2290 (e.g., I-beams). Supports 2290 are optionally disposed at least partially along the length of the surface 2240 and optionally welded to sidewalls 2210, 2220 at opposing ends thereof. A forward support 2295 (e.g., a beam such as a channel beam, I-beam or other support) optionally supports (e.g., is welded to) a forward portion of the support plate 2205. The forward support 2295 is optionally mounted (e.g., by welding) to sidewalls 2210, 2220 such as at opposing ends thereof.

Referring to FIG. 2, a portion of each sidewall 2210, 2220 optionally extends above the surface 2240. A part (e.g., a substantial part) of the portion of each sidewall extending above surface 2240 is optionally protected by one or more removable side liners 2242 (e.g., plates). The side liners 2242 are optionally removably mounted (e.g., by fasteners such as bolts) to the respective sidewalls. The side liners 2242 optionally comprise a wear-resistant material such as abrasion-resistant metal (e.g., steel).

In various embodiments, vibration of the feeder 2200 may comprise a generally elliptical, circular, linear, or other motion or pattern. As shown in FIG. 1, vibration of the feeder 2200 optionally tends to urge aggregate material on the upper surface 2240 to advance (e.g., while bouncing on the surface 2240) generally along travel direction T from a rearward end thereof (e.g., adjacent to a rearward wall 2230 extending laterally between the sidewalls 2210, 2220) toward a forward end thereof (e.g., a forward edge of plate 2244*d*). One or more lifting eyes 2232 are optionally mounted (e.g., welded) to the rearward wall 2230 or elsewhere on the feeder to install or adjust a position of the feeder. Vibration of the feeder 2200 optionally tends to urge aggregate material on the upper surface 2240 to advance (e.g., while bouncing on the surface 2240) generally along the travel direction T from the surface 2240 onto a grizzly bar classifier 2300 which in some embodiments may be referred to as a classifying deck or cassette.

The grizzly bar classifier 2300 optionally comprises a series of longitudinally-extending grizzly bars 2310 (e.g., five grizzly bars). In various embodiments, the grizzly bars may comprise rods, rectangular beams, tubes or other structure. The grizzly bars 2310 are optionally disposed in transversely spaced-apart relation such that undersize material (e.g., aggregate material smaller than the transverse spacing between the bars) tends to fall through the classifier 2300. The undersize material may be processed according to a first post-sorting process, e.g., may be directed by an undersize material chute (not shown) onto a conveyor or other processing equipment. Oversize material (e.g., aggregate material larger than the transverse spacing between bars 2310) optionally tends to fall off a generally forward end of the classifier 2300. Oversize material may be processed according to second post-sorting process, e.g., may be directed by an oversize material chute (not shown) into an input opening of a rock crusher or other processing equipment.

In some embodiments, a grizzly finger classifier (e.g., including grizzly fingers and/or spring fingers) may be incorporated in addition to or alternatively to the grizzly bar classifier described herein. Some such grizzly finger classifiers may be adjustably mounted (e.g., in a fashion similar to the grizzly bar classifiers described herein.) Some grizzly bars or grizzly fingers incorporated in various embodiments may comprise single components or may comprise assemblies (e.g., bimetallic assemblies or assemblies made of a single type of metal or other material). The grizzly bars and/or grizzly fingers of various embodiments may be supported in two or more locations along a length thereof or may be supported at one end thereof (e.g., a rearward end thereof along a general direction of aggregate material travel).

The grizzly bar classifier 2300 is optionally carried on a support structure 2400 that is mounted to side walls 2210, 2220. The support structure 2400 generally comprises one or more transverse support structures, such as support beams or support plates. In one embodiment, support structure 2400 comprises first and second supports and optionally comprises a rearward support 2410 and a forward support 2420. The rearward support 2410 is optionally generally laterally oriented and may be removably mounted at lateral ends thereof to the sidewalls 2210, 2220. The forward support 2420 is optionally generally laterally oriented and is optionally removably mounted at lateral ends thereof to the sidewalls 2210, 2220.

Figure 5:
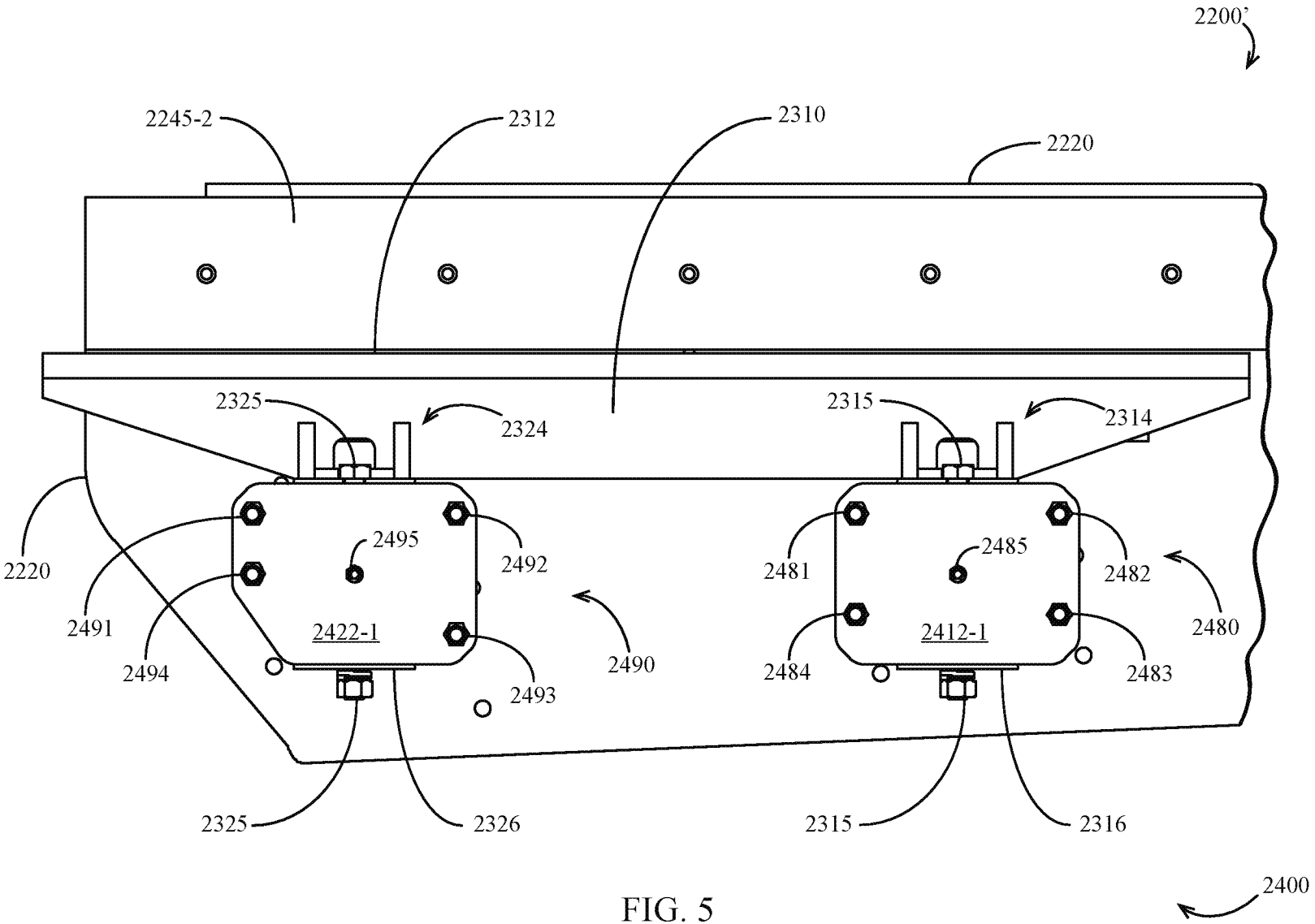
FIG. 5 is a side elevation view of the vibratory classifier of FIG. 1 in the second configuration, with certain components (including a sidewall) not shown for clarity.
Figure 6:
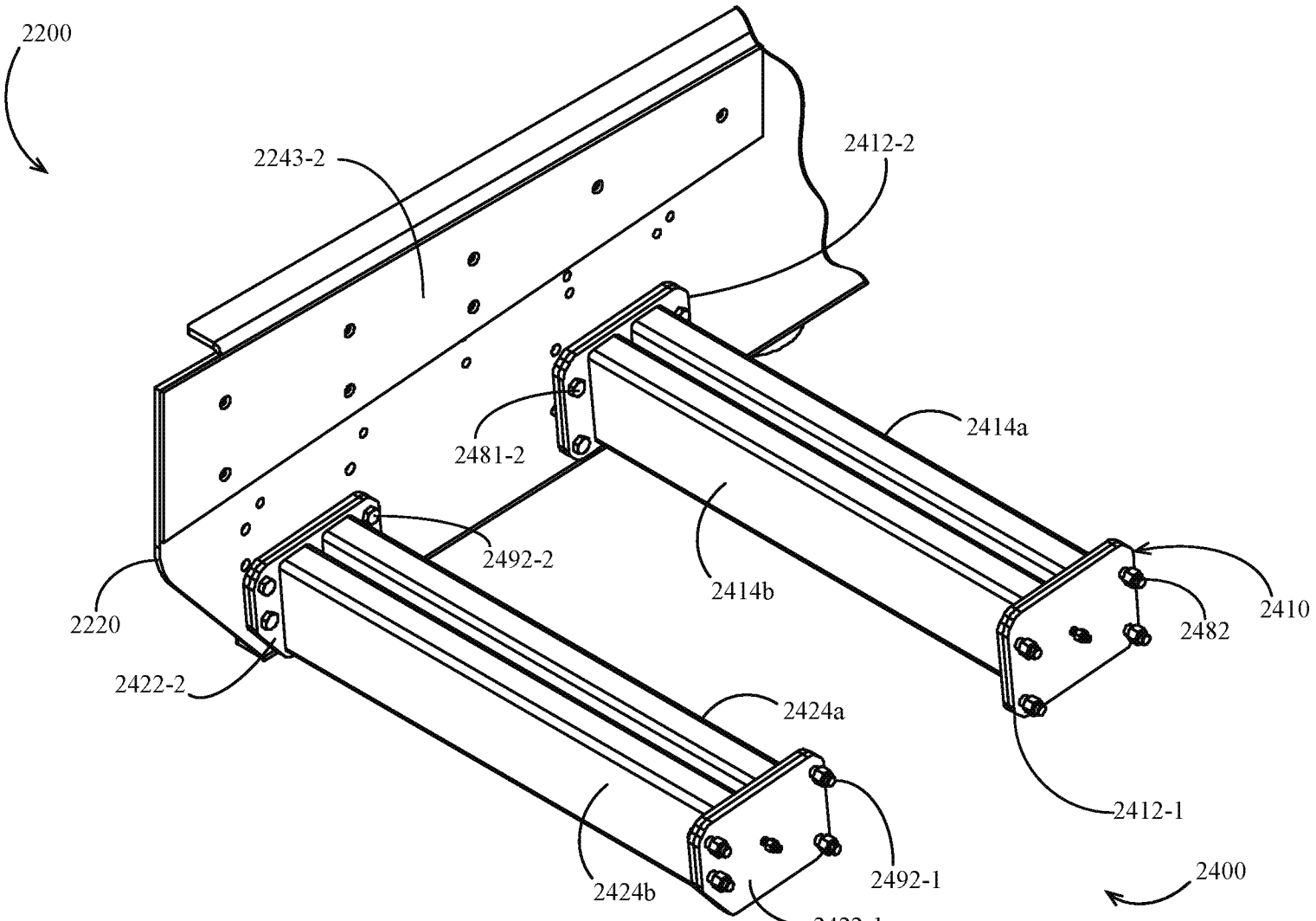
FIG. 6 is a perspective view of the vibratory classifier of FIG. 1 in the first configuration with certain components including a grizzly bar classifier not shown for clarity.
Figure 7:
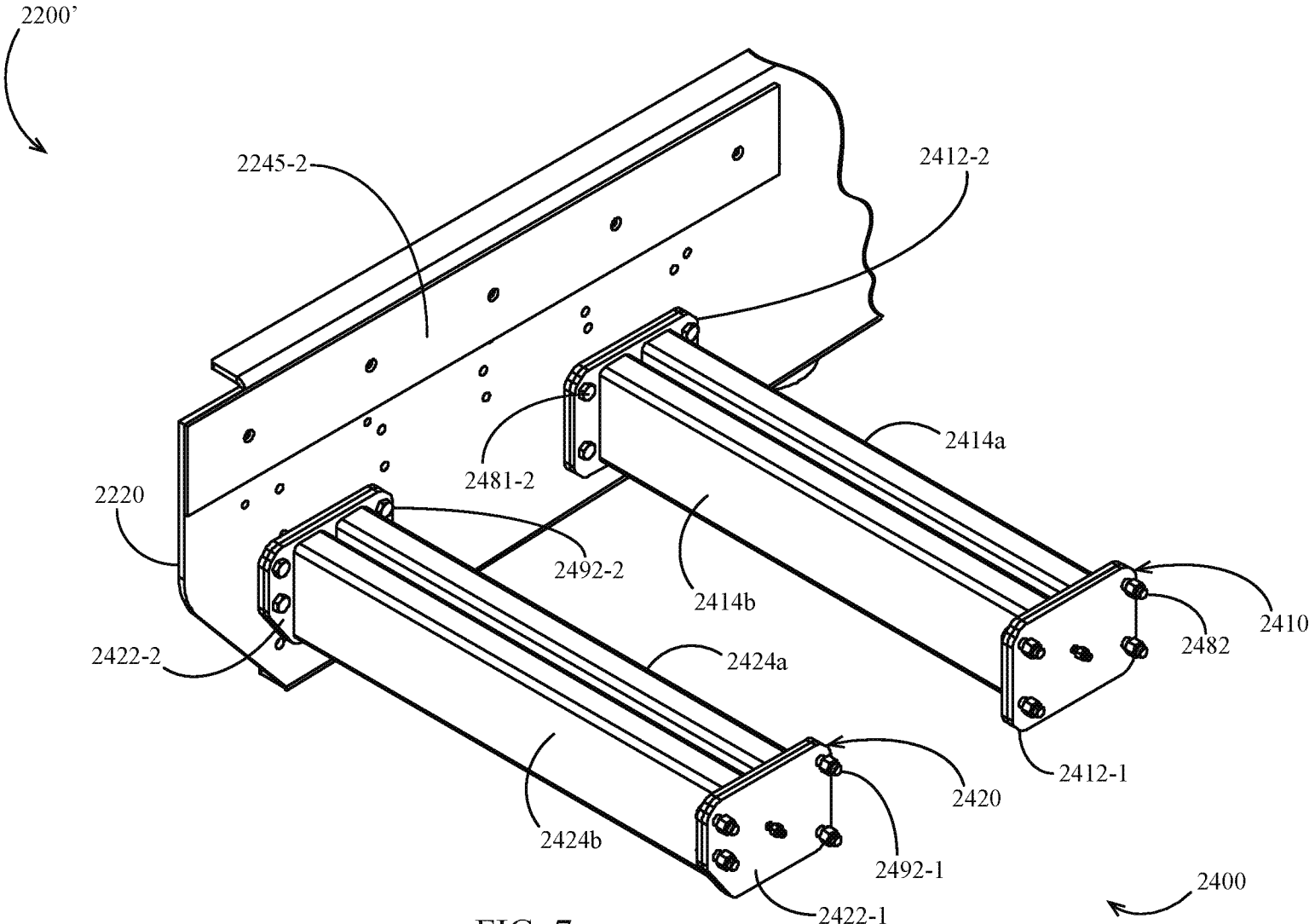
FIG. 7 is a perspective view of the vibratory classifier of FIG. 1 in the second configuration with certain components including a grizzly bar classifier not shown for clarity.

Comparing FIGS. 3 and 5, in FIG. 3 the vibratory classifier 2200 is illustrated in a first configuration in which the grizzly bars of grizzly bar classifier 2300 are oriented at a first angle (e.g., 5 degrees below horizontal, between 4 and 6 degrees below horizontal, about 5 degrees below horizontal, less than about 10 degrees below horizontal, 5 degrees below the plane of surface 2240, about 5 degrees below the plane of surface 2240, less than 10 degrees below the plane of surface 2240 etc.). In the illustrated embodiment the upper surface 2240 is generally level (e.g., horizontal). In alternative embodiments, the grizzly bar classifier 2300 is disposed at an angle above horizontal. In FIG. 5, the vibratory classifier is illustrated in a second configuration (denoted 2200') in which the grizzly bar classifier 2300 is oriented at a second angle with (e.g., about 0 degrees below horizontal, 0 degrees below horizontal, generally parallel to the plane of surface 2240, etc.). In some embodiments, the support 2400 is in a first position in the first configuration and in a second position in the second configuration.

Referring to FIGS. 4-6 and 9, an exemplary embodiment of the classifier 2300 and support 2400 is illustrated in more detail. In the illustrated embodiment, each grizzly bar 2310 is tapered at forward and rearward end thereof; in other embodiments, the grizzly bars may be of a different shape or configuration. In some embodiments, the grizzly bar includes an upper contact portion 2312. Each contact portion 2312 optionally has a width which tapers from the rearward to the forward end thereof; in other embodiments, the contact portion may be of constant width or of a different shape or configuration. In some embodiments, the contact portion 2312 is omitted or replaced with other structure. In some embodiments, the grizzly bar has a different cross-section (e.g., circular, elliptical, rectangular, square, etc.) such that aggregate material contacts an upper surface of the grizzly bar.

The grizzly bars 2310 are optionally removably mounted to the supports 2400. In the illustrated embodiments, forward and rearward mounting footings 2324, 2314, respectively are provided on either or both lateral sides of each bar 2310 for securing the bar to each support 2400. A fastener (e.g., bolt and nut combination) optionally secures each mounting footing to the support 2400. In the illustrated embodiment, a fastener 2325 (e.g., a bolt thereof) extends through each forward mounting footing 2324, optionally through the forward support 2420, and optionally through a mounting plate 2 326 disposed on the bottom of the forward support 2420. In the illustrated embodiment, a fastener 2315 (e.g., a bolt thereof) extends through each rearward mounting footing 2314, optionally through the rearward support 2410, and optionally through a mounting plate 2316 disposed on the bottom of the rearward support 2410. Tightening of each fastener 2315, 2325 removably fixes the associated mounting footing (and optionally the associated plate) to the support.

The rearward support 2410 optionally comprises one or more support beams or other structure which in various embodiments may be of various configurations (e.g., closed, open, generally rectangular, tubular, etc.). In one embodiment, rearward support 2410 comprises a pair of spaced beams, e.g., rearward beam 2414*a* and a forward beam 2414*b*). In the illustrated embodiment, the beams 2414 are mounted (e.g., by welding) at laterally opposing ends to mounting plates 2412-1 and 2412-2. In some embodiments, the mounting plates 2412 include openings for receiving an array of fasteners 2480. The fasteners 2480 are used in some embodiments to mount the rearward support 2410 to corresponding openings in the sidewall 2210.

The forward support 2420 optionally comprises one or more support beams or other structure which in various embodiments may be of various configurations (e.g., closed, open, generally rectangular, tubular, etc.). In one embodiment, forward support 2420 comprises beams (e.g., rearward beam 2424*a* and a forward beam 2424*b*). In the illustrated embodiment, the beams 2424 are mounted (e.g., by welding) at laterally opposing ends to mounting plates 2422-1 and 2422-2. In some embodiments, the mounting plates 2422 include openings for receiving an array of fasteners 2490. The fasteners 2490 are used in some embodiments to mount the rearward support 2410 to corresponding openings in the sidewall 2220.

An array of openings is optionally provided in each sidewall (or other supporting structure) for removably mounting each mounting plate of the support 2400 with associated fasteners. In some embodiments, a plurality of (e.g., two) arrays of openings are provided for each mounting plate; one of each plurality of arrays of openings may be selected in order to select an orientation of the support 2400 and thus of the classifier 2300 supported by the support 2400.

In the illustrated embodiment, each rearward support 2410 includes openings for receiving an array of fasteners 2480. The array of fasteners 2480 may include four fasteners 2481, 2482, 2483, 2484 as illustrated. The array of fasteners 2480 is optionally arranged generally in a polygonal (e.g., rectangular arrangement external to the beams 2414. An additional fastener 2485 is optionally disposed between the beams 2414.

In the illustrated embodiment, each forward support 2420 includes openings for receiving an array of fasteners 2490. The array of fasteners 2490 may include four fasteners 2491, 2492, 2493, 2494 as illustrated. The array of fasteners 2490 is optionally arranged external to the beams 2424. Fasteners 2491 and 2494 are separated by a first distance (e.g., height) which is optionally less than a second distance (e.g., height) separating fasteners 2492 and 2493. An additional fastener 2495 is optionally disposed between the beams 2424. The arrangement of the array of fasteners 2480 is optionally different from the arrangement of the array of fasteners 2490. In some embodiments, the array of fasteners 2490 forms an irregular polygon (e.g., rectangle).

Figure 11:
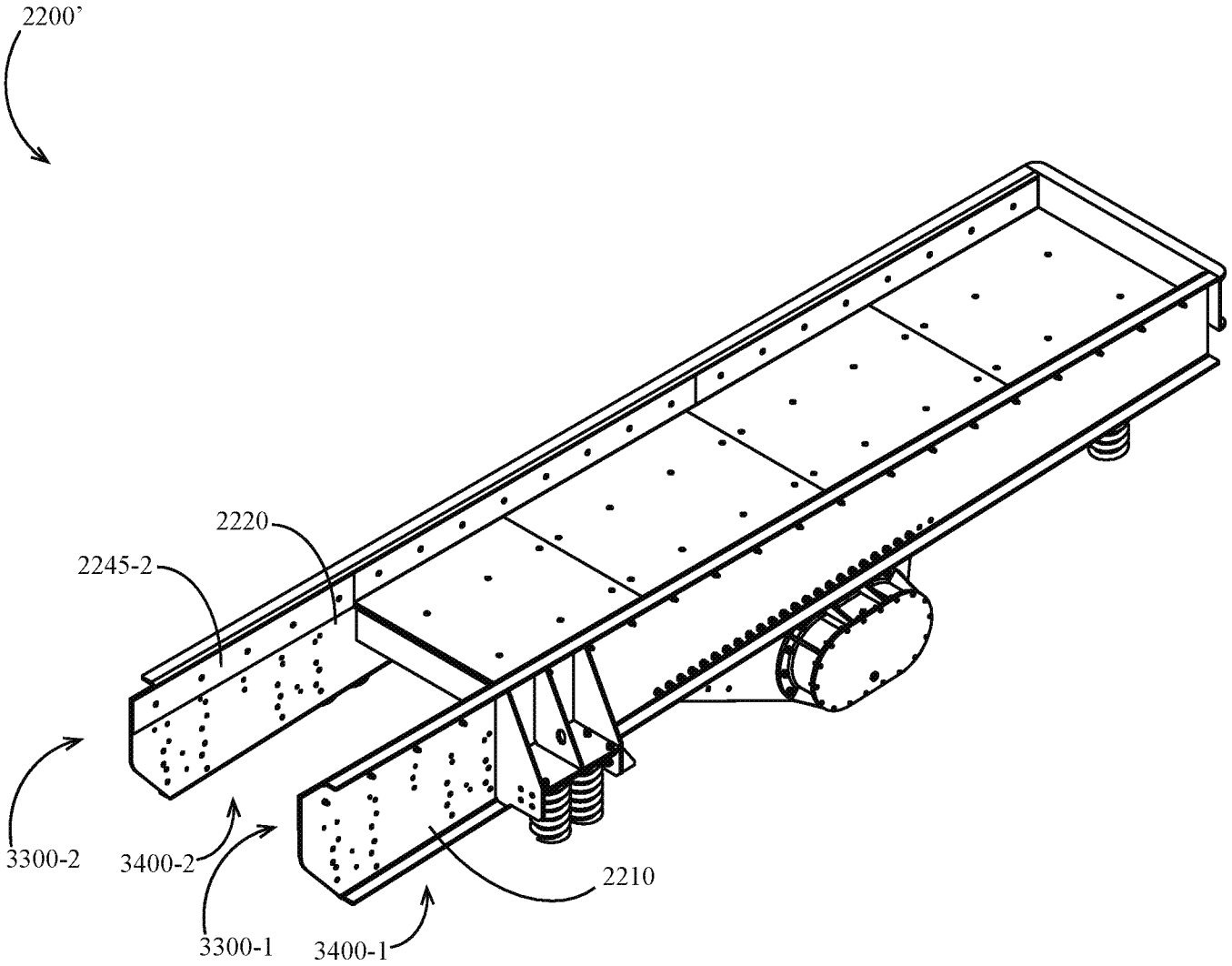
FIG. 11 is a perspective view of the vibratory classifier of FIG. 1 with certain components including a grizzly bar classifier and supports removed for clarity.
Figure 12:
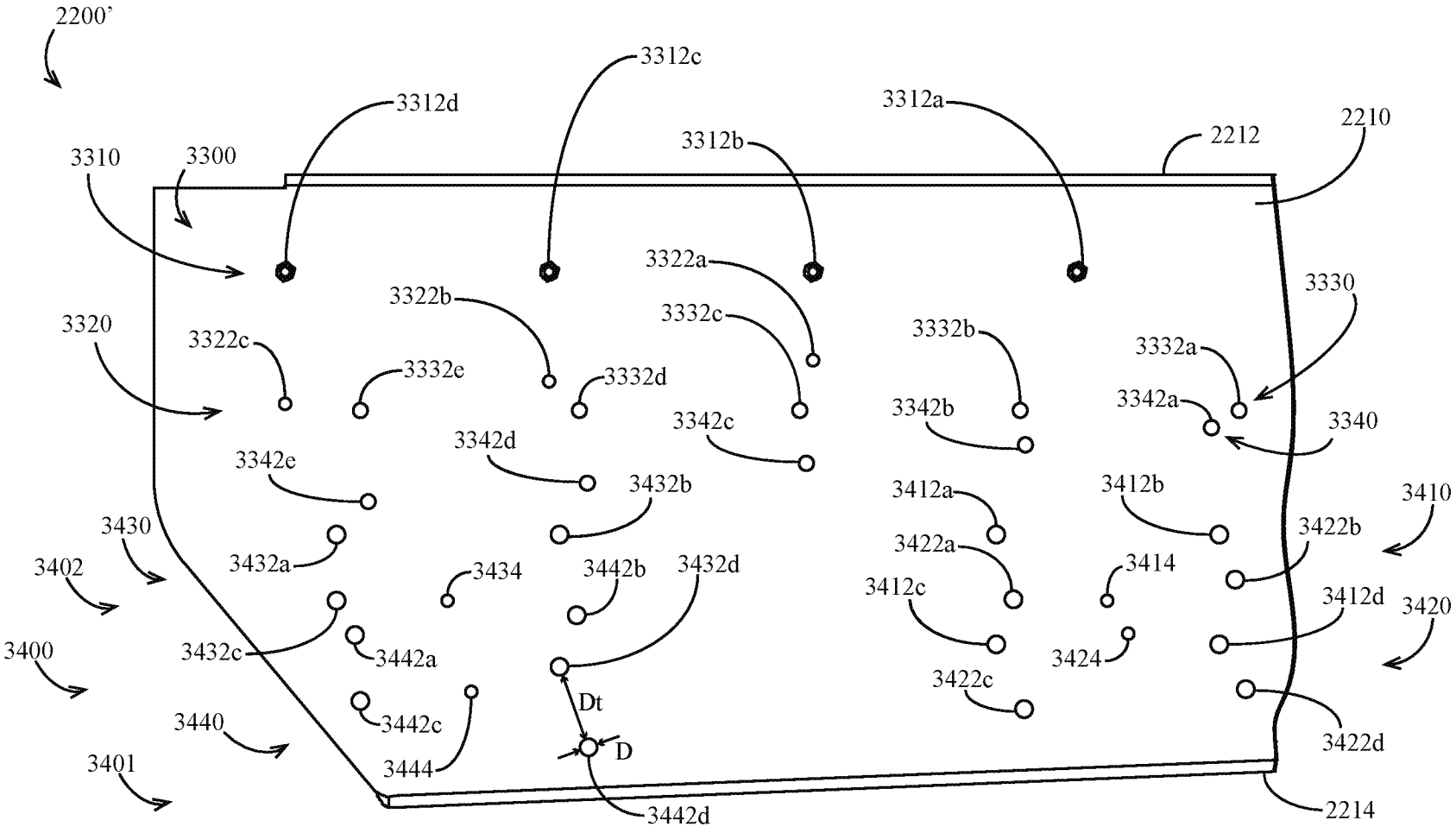
FIG. 12 is a side elevation view of the vibratory classifier of FIG. 1 with certain components including a grizzly bar classifier and supports removed for clarity.

Referring to FIGS. 11 and 12, in some embodiments arrays of openings 3400-1, 3400-2 are provided in each sidewall 2210, 2220, respectively, for removably mounting the support 2400 in one or more configurations. In some embodiments each array of openings 3400 includes a lower array 3401 for removably mounting the support 2400 in the first configuration (e.g., 5 degrees below horizontal). In some embodiments each array of openings 3400 includes an upper array 3402 for removably mounting the support 2400 in the second configuration (e.g., generally horizontal). In the illustrated embodiment, the upper array 3402 and the lower array 3401 overlap in the sense that individual openings of the lower array are disposed higher than individual openings of the upper array. However, individual openings of the upper and lower arrays optionally do not overlap and optionally are separated by at least a threshold distance (e.g., one millimeter, five millimeters, 10 millimeters, 20 millimeters, 50 millimeters a quarter-inch, a half-inch, an inch, two inches, etc.). The threshold distance optionally leaves sufficient material between openings such that the strength of the sidewall (e.g., the portion of the sidewall between the openings) is not substantially compromised by the proximity of the openings. In some embodiments, one or more openings of the first and second forward arrays of openings 3430, 3440 (e.g., all openings, at least one opening, two or more openings, three or more openings) in one or both sidewalls 2210, 2220 have a diameter D. Referring to FIG. 12, in various embodiments, the threshold distance Dt between any opening in the upper array 3430 and any opening in the lower array 3440 is optionally greater than the diameter D, greater than D/2, greater than D/3, etc.

In the illustrated embodiment, each lower array 3401 includes a rearward array 3420 opening for supporting the rearward support 2410 in the first configuration (e.g., by the array of fasteners 2480). The rearward array 3420 optionally includes a plurality of openings 3422 arranged in a generally polygonal (e.g., rectangular) arrangement. The rearward array 3420 optionally includes an inner opening 3424.

In the illustrated embodiment, each lower array 3401 includes a forward array 3440 opening for supporting the forward support 2420 in the first configuration (e.g., by the array of fasteners 2490). The forward array 3440 optionally includes a plurality of openings 3442 (e.g., 3442*a*, 3442*b*, 3442*c*, 3442*d*) arranged in a generally polygonal (e.g., irregular rectangular) arrangement. The forward array 3440 optionally includes an inner opening 3444.

In the illustrated embodiment, each upper array 3402 includes a rearward array 3410 opening for supporting the rearward support 2410 in the second configuration (e.g., by the array of fasteners 2480). The rearward array 3410 optionally includes a plurality of openings 3412 arranged in a generally polygonal (e.g., rectangular) arrangement. The rearward array 3410 optionally includes an inner opening 3414.

In the illustrated embodiment, each upper array 3402 includes a forward array 3430 opening for supporting the forward support 2420 in the second configuration (e.g., by the array of fasteners 2490). The forward array 3430 optionally includes a plurality of openings 3432 (e.g., 3432*a*, 3432*b*, 3432*c*, 3432*d*) arranged in a generally polygonal (e.g., irregular rectangular) arrangement. The forward array 3430 optionally includes an inner opening 3434.

In some embodiments, the offset position of openings 3442*c* and 3432*c* (or in other embodiments the offset position of other openings or other mounting features) causes the arrays 3440, 3430 to have an irregular polygonal (e.g., irregular rectangular) arrangement. In the illustrated embodiment, the offset position of the openings 3442*c*, 3432*c* avoids overlap and/or separation by less than the threshold distance between the openings 3432*c* and 3442*a*. Other configurations (e.g., irregular polygonal configurations) of the arrays of openings are possible in order to avoid overlap and/or less-than-threshold separation of individual openings in the upper and lower arrays 3401, 3402.

Figure 4:
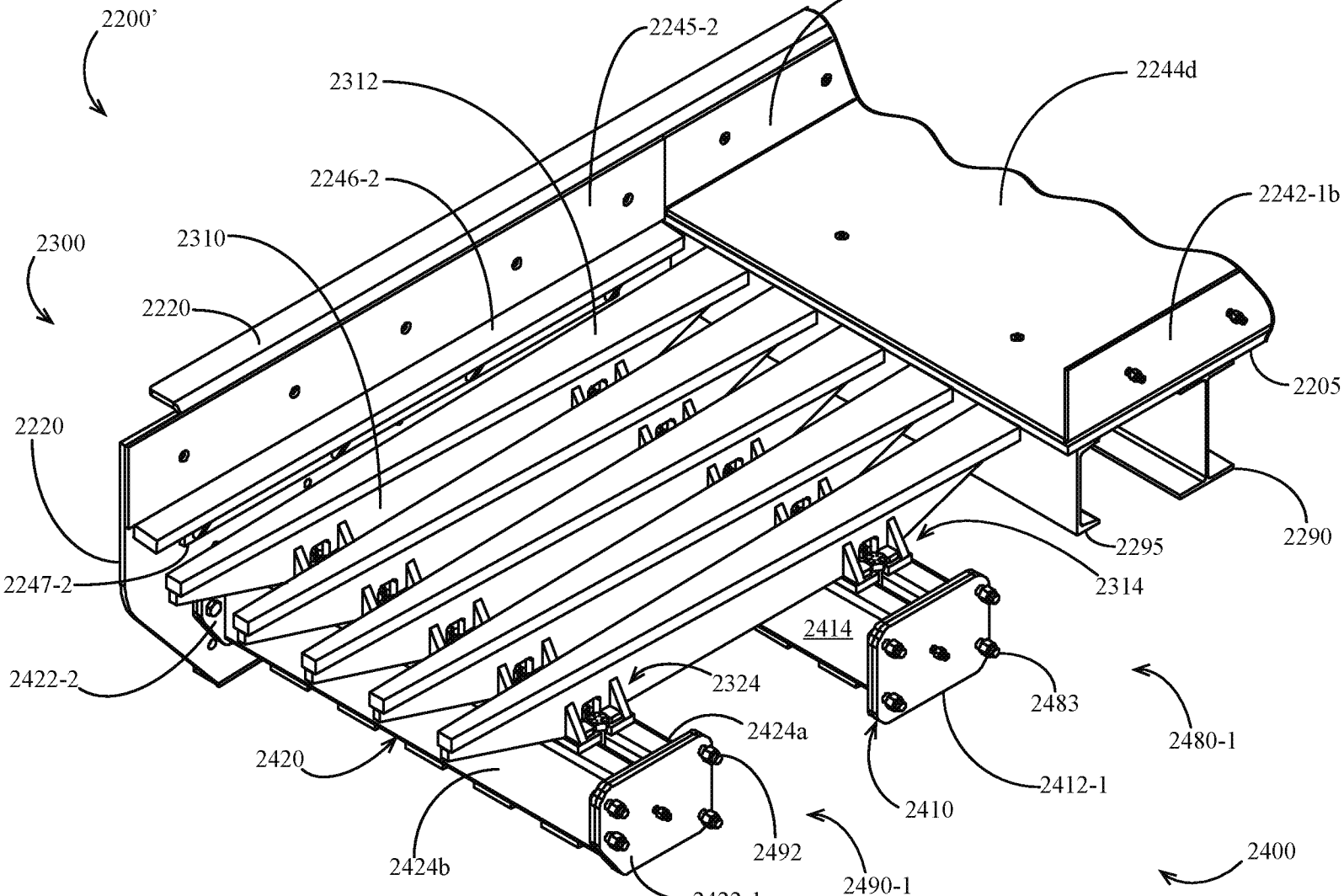
FIG. 4 is a perspective view of the vibratory classifier of FIG. 1 in a second configuration, with certain components including a sidewall not shown for clarity.
Figure 9:
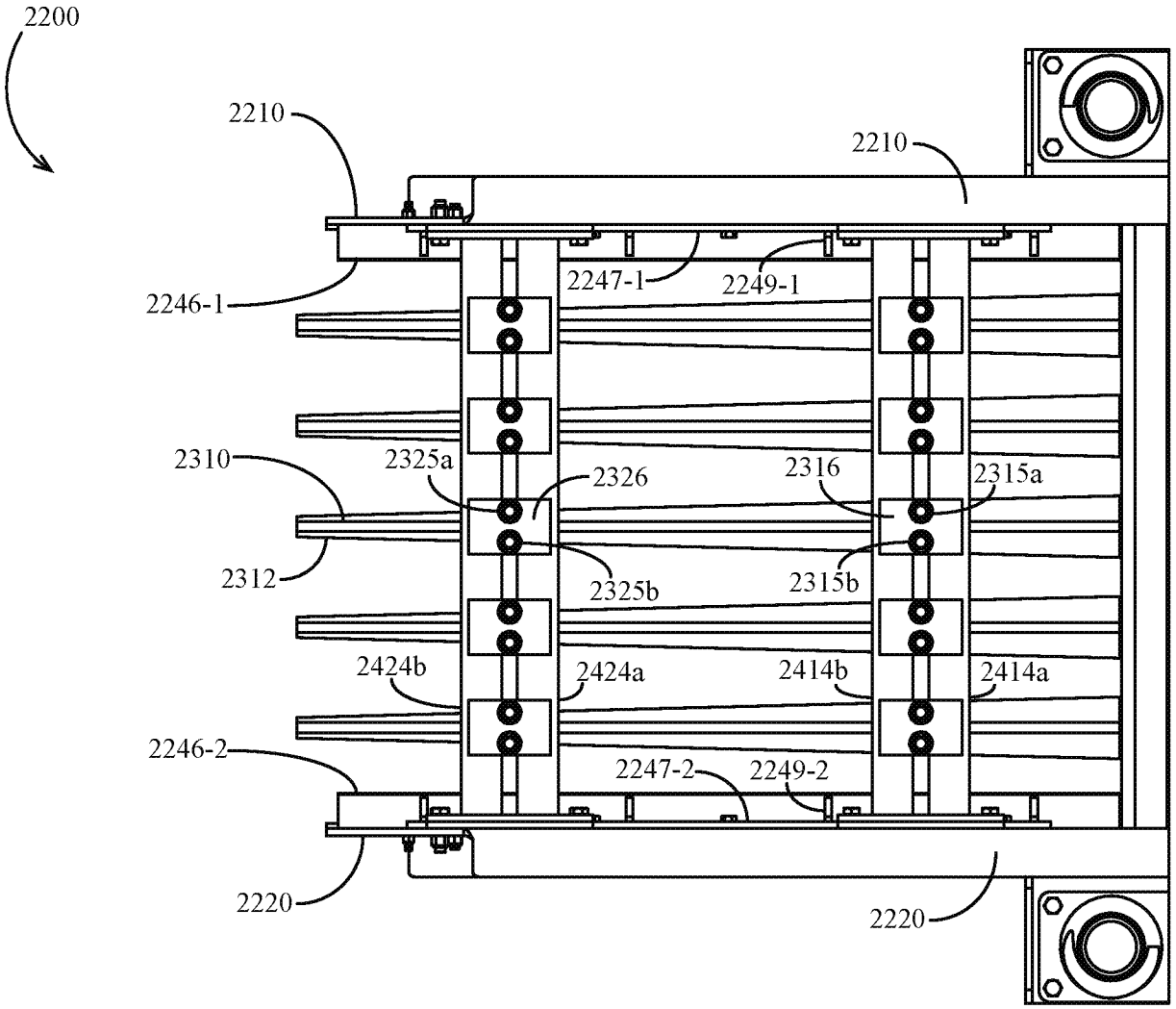
FIG. 9 is an enlarged partial bottom view of the vibratory classifier of FIG. 1 illustrating the grizzly bar classifier.

Referring to FIGS. 4 and 9, in some embodiments side bars 2246-1, 2246-2 are mounted to the sidewalls 2210, 2220, respectively. The side bars 2246 are optionally disposed to the side of the classifier 2300. The side bars 2246 optionally extend generally parallel to the classifier 2300. The side bars 2246 optionally comprise upward-facing contact surfaces. The side bars 2246 are optionally made from a metal such as abrasion-resistant steel. The side bars 2246 are optionally mounted to respective sidewalls by mounting plates 2247 (e.g., vertical mounting plates removably fastened to each sidewall). The mounting plates 2247 optionally support side bars 2246 by angle supports 2249 (e.g., angle plates or angle brackets).

The side bars 2246 are optionally removably mounted to the sidewalls 2210, 2220 (e.g., by fasteners such as nut-and-bolt combinations) such that the side bars may be adjusted between a first configuration (e.g., generally parallel to the first configuration of the classifier 2300) and a second configuration (e.g., generally parallel to the second configuration of the classifier 2300).

Referring to FIGS. 11 and 12, each sidewall 2210, 2220 optionally includes an array of openings 3340 (e.g., a generally linearly arranged array as illustrated) having a plurality of openings 3342 (e.g., 3342*a*, 3342*b*, 3342*c*, 3342*d*, 3342*e*) for supporting the side bar 2246 in the first configuration. Each array of openings 3340 optionally extends generally parallel to the first configuration of the classifier 2300.

Referring to FIGS. 11 and 12, each sidewall 2210, 2220 optionally includes an array of openings 3330 (e.g., a generally linearly arranged array as illustrated) having a plurality of openings 3332 (e.g., 3342*a*, 3342*b*, 3342*c*, 3342*d*, 3342*e*) for supporting the side bar 2246 in the second configuration. Each array of openings 3330 optionally extends generally parallel to the second configuration of the classifier 2300.

Referring to FIGS. 2 and 4, side liners are optionally removably mounted to each of the sidewalls 2210, 2220 and positioned adjacent to the classifier 2300. The side liners optionally protect the sidewalls 2210, 2220 from contact with aggregate material bouncing on the classifier 2300. The side liners may be made of wear-resistant material such as abrasion-resistant steel. The side liners may comprise plates of such material as illustrated.

The side liners are optionally modifiable or replaceable when changing the position of the side bars 2246 and/or classifier 2300. Comparing FIGS. 2 and 4, a first side liner 2243 (2243-2) is optionally removably mounted to each sidewall when the classifier 2300 is in the first configuration and a second side liner 2245 is optionally removably mounted to each sidewall when the classifier 2300 is in the second configuration. Each side liner 2243, 2245 optionally substantially covers a vertical portion of the associated sidewall disposed above the classifier 2300. In other embodiments, an additional side liner portion (e.g., triangular portion) is optionally added in the first configuration and removed in the second configuration.

Referring to FIG. 12, an array of openings 3300 is optionally provided in each side wall to support the side liners. The array 3300 optionally includes a first array 3310 and a second array 3320. The first array 3310 optionally includes a plurality of openings 3312 (e.g., 3312*a*, 3312*b*, 3312*c*, 3312*d*). A second array of openings 3320 is optionally provided in each side wall to support the second side liner 2245. The second array 3320 optionally includes a plurality of openings 3322 (e.g., 3222*a*, 3322*b*, 3322*c*). The second array 3320 may be disposed below the first array 3310 as illustrated. The second array 3320 may be disposed at an angle to a horizontal as illustrated (e.g., generally parallel to the classifier 2300 in the first configuration).

Figure 13:
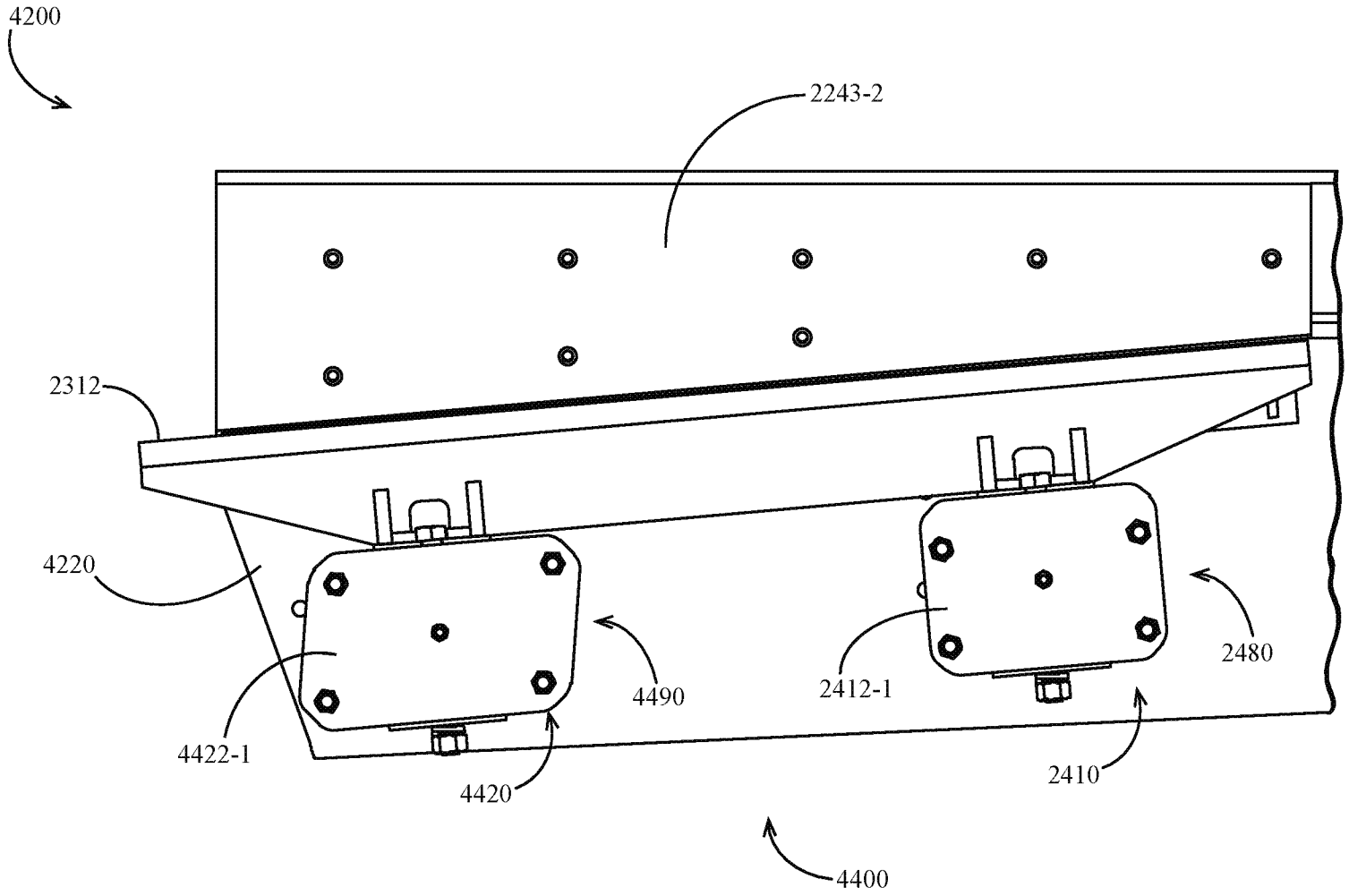
FIG. 13 is a partial side elevation view of another embodiment of a vibratory classifier.
Figure 14:
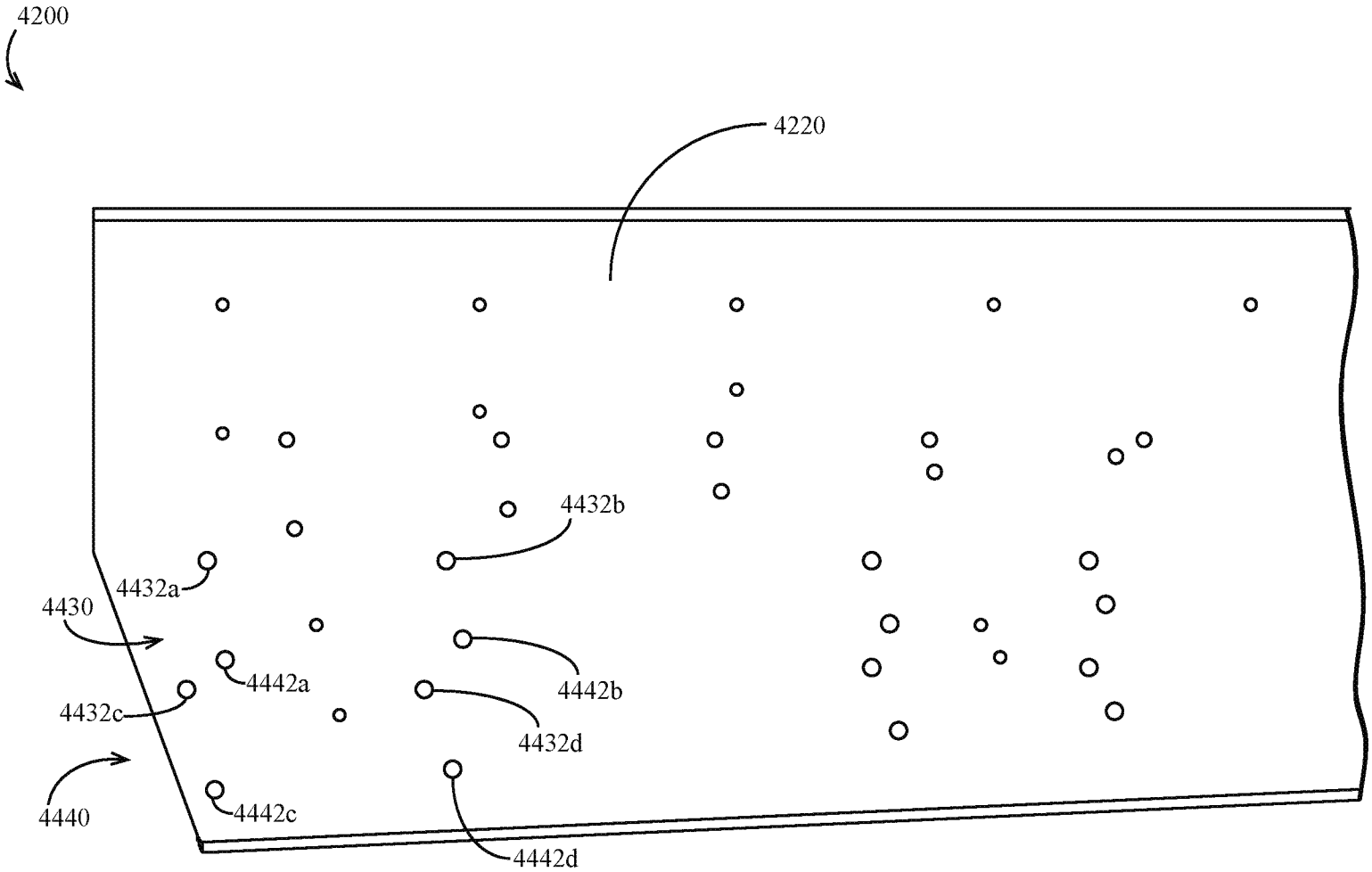
FIG. 14 is a partial side elevation view of a sidewall of the vibratory classifier of FIG. 13.

Referring to FIGS. 13 and 14, an alternative embodiment of a vibratory feeder 4200 is illustrated. The vibratory feeder 4200 is optionally generally similar to the vibratory feeder 4200, except that the vibratory feeder 4200 optionally comprises a grizzly classifier having a modified forward support and sidewalls as described below.

The vibratory feeder 4200 optionally comprises support 4400 including a modified forward support 4420 having an array of fasteners 4490 optionally arranged in a parallelogram (e.g., slanted parallelogram, oblique parallelogram, etc.) arrangement. The fasteners 4490 optionally extend through a modified forward mounting plate 4422.

The sidewalls (e.g., sidewall 4220) of the vibratory feeder 4200 optionally include a plurality of modified forward arrays of openings corresponding to the array of fasteners 4490. Referring to FIG. 14, a first forward array 4430 of openings 4432 (e.g., 4432*a*, 4432*b*, 4432*c*, 4432*d*) is optionally disposed to support the forward support 4420 so that the grizzly classifier is in a first orientation (e.g., generally horizontal, at about 0 degrees below horizontal, etc.). A second forward array 4440 of openings 4442 (e.g., 4442*a*, 4442*b*, 4442*c*, 4442*d*) is optionally disposed to support the forward support 4420 so that the grizzly classifier is in a second orientation (e.g., at 5 degrees below horizontal, at about 5 degrees below horizontal, at less than 10 degrees below horizontal, etc.). Each of the first and second forward arrays 4430, 4440 are optionally arranged in a parallelogram (e.g., slanted parallelogram, oblique parallelogram, etc.) arrangement. The fasteners 4490 optionally extend through the openings 4432 in the first orientation and optionally extend through the openings 4442 in the second orientation.

In some alternative vibratory feeder embodiments, multiple grizzly bar classifiers are incorporated. For example, two, three or more grizzly may be disposed in vertically stacked or stair-stepped relation. In various embodiments, one or more of such classifiers may be adjustably mounted as described elsewhere herein.

In some alternative vibratory feeder embodiments (and/or other classifier embodiments), one or more classifying decks being adjustably-mounted as described herein comprise differently-configured grizzly bars (e.g., with or without contact portions, having round or other cross-sections, etc.), other types of sorting or classifying bars, classifying media such as plastic or metal screens, etc.

In some vibratory feeder embodiments, material exits the feeder through an opening such as a hole disposed in a bottom end of the feeder rather than through an open end of the feeder.

In some vibratory feeder embodiments, the feeder is supported from above such as on cables or other support structure.

In some vibratory feeder embodiments, mounting holes (or other attachment structure) are provided in an inner wall (or other structure) separate from the feeder sidewalls for mounting a grizzly bar classifier in two or more configurations. The inner wall (or other structure) is optionally supported on the sidewalls.

In some vibratory feeder embodiments, mounting holes (or other attachment structure) are provided in left and right mounting plates (or other structure) independently moveable relative to a sidewall of the feeder. A grizzly bar classifier is mounted to the left and right mounting plates, which are adjustably mounted by sidewall mount fasteners to the left and right sidewalls (or other structure) by one or more fasteners. For example, a sidewall mount fastener may be inserted in one or more openings in the sidewall or in an arcuate slot in the sidewall for adjustment of the mounting plates and grizzly bar classifier between a plurality of configurations (e.g., a horizontal configuration and one or more sloped configurations).

In some embodiments, at least a portion of the surface 2240 is curved (e.g., forming a trough-shaped surface) or sloped along a longitudinal (e.g., along direction T) or transverse direction. In some embodiments, the surface 2240 may be omitted such that aggregate material is received directly on a grizzly classifier or other component.

In some embodiments, a grizzly bar classifier (e.g., a laterally-extending support thereof such as a rearward support) is pivotally coupled (e.g., by bearings or other structure) to one or more sidewalls of the vibratory feeder. In some embodiments, an actuator such as a hydraulic cylinder is used to modify an orientation of the grizzly bar classifier.

Spring Suspension Embodiments

Figure 10:
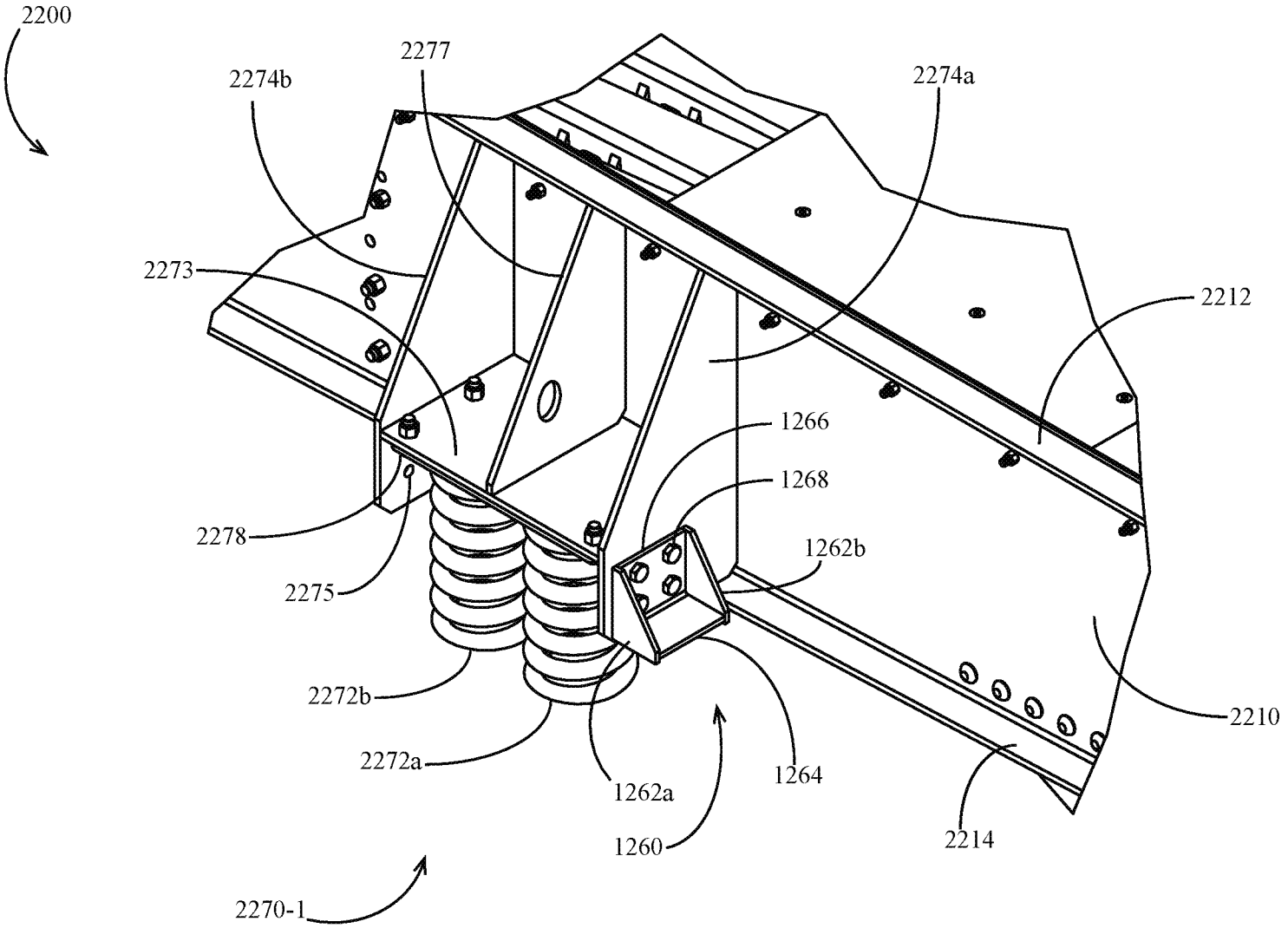
FIG. 10 is an enlarged perspective view of the vibratory classifier of FIG. 1 illustrating a spring assembly having a lift support.

Referring to FIG. 10, each of the sidewalls 2210, 2220 of the feeder 2200 optionally includes a spring suspension system 2270-1, 2270-2, respectively.

The spring suspension may include one or more springs 2272 (e.g., 2272*a*, 2272*b*) resiliently supporting a generally horizontal plate 2273 as illustrated. The horizontal plate 2273 may removably support (e.g., by fasteners such as bolts) a spring support 2278 which optionally includes downwardly-extending cylinders (not shown) or other features for holding the springs 2272 in position. The horizontal plate 2273 is optionally mounted (e.g., by welding) to the associated sidewall of the feeder. The horizontal plate is also optionally mounted (e.g., by welding) to one or more side support plates 2274 (e.g., 2274*a*, 2274*b*). The side support plates 2274 are optionally mounted (e.g., by welding) to the associated sidewall. In the illustrated embodiment, the side support plates 2274 extend substantially along a height of the sidewall (e.g., from a lower lip 2214 to an upper lip 2212 of the sidewall 2210). An additional angle support 2277 (e.g., angle plate) may additionally be mounted (e.g., welded) to both the horizontal plate 2273 and to the sidewall.

A support assembly 1260 is optionally adjustably mounted to at least one of the side support plates 2274. The support assembly 1260 optionally includes a support surface 1264 (e.g., a horizontal plate as illustrated) which is optionally sized and configured to support at least a portion of the weight of the feeder 2200 on a lifting device (e.g., lift jack) disposed between the support surface and a base such as a base member or the ground. The support surface 1264 optionally extends away from the spring suspension system 2270 (and/or from the sidewall) such that an open space is disposed vertically between the support surface 1264 and the base member (and/or the ground). The open space is optionally sized to receive at least a portion of the lifting device (e.g., lift jack).

In some embodiments, the support surface 1264 is optionally formed as a part with ot or otherwise joined to an angle bracket 1266 which is removably fastened (e.g., by bolts 1268) to the side support plate 2274). In some embodiments, the support assembly 1260 additionally includes one or more plates 1262 mounted (e.g., by welding) to the support surface 1264 and/or the angle bracket 1266 for strengthening the angle bracket and/or the support surface 1264.

In some embodiments, the support assembly 1260 is adjustable. For example, the height of the support surface 1264 may be adjustable by selecting which of an array of vertically spaced holes 2275 in side support plates 2274 to which to fix the support assembly 1260 to the sidewall (e.g., using removable bolts 1268). The support assembly 1260 may also have two or more orientations (e.g., a first orientation and a second orientation vertically flipped from the first orientation); in a first orientation (e.g., the orientation illustrated in FIG. 10), the support surface 1262 is optionally disposed higher relative to the base member (and/or the ground) than in the second orientation (e.g., an orientation vertically flipped from that illustrated in FIG. 10). The support surface 1264 is optionally disposed to provide a support surface for the lifting device (e.g., is disposed generally horizontally) in both the first and second orientations.

In some embodiments, a maximum height to which the support surface 1264 may be adjusted relative to an upper surface base member is approximately equal to a height of one of the springs of the spring suspension system 2270. The maximum height of the support surface 1264 relative to the ground may be approximately twice the height of the spring and/or approximately equal to the height of the spring plus a height of the base member.

In some embodiments, the support assembly 1260 and corresponding adjustable mounting structure described above may be mounted to other portions of the spring suspension system 2270 or to other structure on the feeder 2200 such as the sidewalls thereof.

Although specific embodiments have been illustrated and described, it will be appreciated by those of ordinary skill in the art that a variety of alternate and/or equivalent implementations may be substituted for the specific embodiments shown and described without departing from the scope of the disclosure. This application is intended to cover any adaptations or variations of the specific embodiments of the support structures described herein. Therefore, it is intended that the specification is exemplary in nature, and that the scope of the invention is solely defined by the claims the equivalents thereof. For example, any feature described for one embodiment may be used with any other embodiment.

What is claimed is:

1. A vibratory feeder for classifying aggregate material, comprising:

a first sidewall having a first length;

a second sidewall having a second length;

a vibratory mechanism operably coupled to at least one of said first and second sidewalls;

a deck supported between said first and second sidewalls along a first portion of the first and second length;

a grizzly bar classifier supported between said first and second sidewalls along a second portion of the first and second length said grizzly bar classifier comprising:

a plurality of laterally spaced-apart grizzly bars, said grizzly bars being generally parallel to said first and second sidewalls;

a support connected to said first and second side walls, said plurality of grizzly bars being carried on said support wherein said first sidewall includes:

a first array of openings for connecting said support in a first configuration;

and a second array of openings for connecting said support in a second configuration, at least one of said first array of openings being disposed within said second array of openings, said grizzly bars being downwardly sloped at a first angle in said first configuration, said grizzly bars being generally horizontally oriented in said second configuration.

2. The vibratory feeder of claim 1, wherein said support comprises:

a rear support extending laterally beneath said grizzly bars and operably supporting said grizzly bars;

a forward support extending laterally beneath said grizzly bars and operably supporting said grizzly bars;

a forward mounting plate coupled to said forward support; and a forward set of fasteners for coupling said forward mounting plate to said first sidewall, each of said forward set of fasteners extending laterally at least partially through said forward mounting plate.

3. The vibratory feeder of claim 2, wherein said first array of openings is arranged to receive said forward set of fasteners at least partially therethrough in the first configuration, and wherein said second array of openings is arranged to receive said forward set of fasteners at least partially therethrough in the second configuration.

4. The vibratory feeder of claim 3, wherein said first array of openings is arranged to form an irregular polygon.

5. The vibratory feeder of claim 4, wherein said second array of openings is arranged to form an irregular polygon.

6. The vibratory feeder of claim 1, wherein at least one of said second array of openings is disposed within said first array of openings.

7. The vibratory feeder of claim 1, wherein said first array of openings is arranged to form an oblique rectangle.

8. The vibratory feeder of claim 1, wherein three openings of said first array of openings form first through third vertices of a right rectangle, and wherein a fourth opening of said first array of openings is offset from a fourth vertex of said right rectangle.

9. The vibratory feeder of claim 1, wherein at least one of said first array of openings has a diameter D, wherein each of said first array of openings is spaced apart from any of said second array of openings by at least a distance Dt, said distance Dt being greater than zero.

10. The vibratory feeder of claim 9, wherein said distance Dt is at least as great as said diameter D.

11. The vibratory feeder of claim 9, wherein said distance Dt is at least as great as half of said diameter D.

12. The vibratory feeder of claim 1, wherein said first sidewall further comprises:

a first plurality of side liner support openings for supporting a first sideliner adjacent to said grizzly bar classifier in said first configuration, said second sideliner being configured to substantially cover a portion of said first sidewall above said grizzly bar classifier in said second configuration; and a second plurality of side liner support openings for supporting a second sideliner adjacent to said grizzly bar classifier in said second configuration, said second side liner being configured to substantially cover a portion of said first sidewall above said grizzly bar classifier in said second configuration.

13. The vibratory feeder of claim 1, wherein said first sidewall further comprises:

a first plurality of side bar support openings for supporting a side bar parallel to said grizzly bars in said first configuration; and a second plurality of side liner support openings for supporting said side bar parallel to said grizzly bars in said second configuration.

14. The vibratory feeder of claim 1, further comprising:

a rear mounting plate coupled to said rear support;

a rear set of fasteners for coupling said rear mounting plate to said first sidewall, each of said rear set of fasteners extending laterally at least partially through said rear mounting plate, wherein said first sidewall further includes:

a first rear array of openings, said first rear array arranged to receive said rear set of fasteners at least partially therethrough in the first configuration; and a second rear array of openings, said second rear array arranged to receive said rear set of fasteners at least partially therethrough in the second configuration.

15. The vibratory feeder of claim 14, wherein said forward array of openings form vertices of an irregular polygon.

16. The vibratory feeder of claim 15, wherein said rear array of openings form vertices of a right rectangle.

17. The vibratory feeder of claim 14, wherein said forward array of openings form vertices of an oblique rectangle.

18. The vibratory feeder of claim 17, wherein said rear array of openings form vertices of a right rectangle.

19. The vibratory feeder of claim 1, further comprising:

a first spring suspension system mounted to said first sidewall; and a second spring suspension system mounted to said second sidewall.

20. A method of reconfiguring a grizzly bar classifier of a vibratory grizzly feeder, the method comprising:

dismounting a grizzly bar classifier support from a first array of sidewall openings in a sidewall;

reorienting said grizzly bar classifier support from a first orientation to a second orientation; and mounting said grizzly bar classifier support to a second array of sidewall openings in said sidewall, said first array overlapping said second array, wherein at least one of said first array of openings is disposed within said second array of openings, said grizzly bar classifier supported on said grizzly bar classifier support being downwardly sloped at a first angle in said first orientation, said grizzly bar classifier supported on said grizzly bar classifier support being generally horizontal in said second orientation.

21. The method of claim 20, wherein said second array of sidewall openings is arranged in an irregular polygonal shape.

22. The method of claim 20, further comprising:

removing a first side liner from said sidewall;

with a second side liner, covering a substantial portion of said sidewall above said grizzly bar classifier;

mounting said second side liner to said sidewall.

23. The method of claim 20, further comprising:

removing a side bar from said sidewall;

reorienting said side bar to be parallel with said grizzly bar classifier in the second configuration; and mounting said side bar to said sidewall.

* * * * *